US007654762B2

(12) United States Patent
Carlino

(10) Patent No.: US 7,654,762 B2
(45) Date of Patent: Feb. 2, 2010

(54) PEN/PENCIL APPARATUS HAVING COSMETIC APPLICATION

(76) Inventor: Cristina Carlino, 4304 E. Standord, Phoenix, AZ (US) 85016

( * ) Notice: Subject to any disclaimer, the term of this patent is extended or adjusted under 35 U.S.C. 154(b) by 295 days.

(21) Appl. No.: 11/456,399

(22) Filed: Jul. 10, 2006

(65) Prior Publication Data

US 2006/0245812 A1 Nov. 2, 2006

Related U.S. Application Data

(63) Continuation of application No. 10/308,824, filed on Dec. 2, 2002.

(51) Int. Cl.
*B43K 27/02* (2006.01)

(52) U.S. Cl. ..... 401/19; 401/17; 401/20; 401/52

(58) Field of Classification Search ..... 401/17, 401/19–21, 29, 31, 52, 57, 89, 90, 195; D19/36
See application file for complete search history.

(56) References Cited

U.S. PATENT DOCUMENTS

| | | | | |
|---|---|---|---|---|
| 1,554,769 | A * | 9/1925 | Visitacion | 401/20 |
| 2,354,402 | A * | 7/1944 | Petruccione et al. | 401/195 |
| 4,600,327 | A | 7/1986 | Guzman | |
| 5,338,123 | A | 8/1994 | Obersteller et al. | |
| 5,356,232 | A | 10/1994 | Skinner | |
| 5,722,436 | A | 3/1998 | Vandromme et al. | |
| 6,241,408 | B1 * | 6/2001 | Lang | 401/17 |
| 6,368,001 | B1 | 4/2002 | Roeder | |
| 2001/0036383 | A1 * | 11/2001 | Cirlin et al. | 401/57 |

* cited by examiner

*Primary Examiner*—Tuan N Nguyen
(74) *Attorney, Agent, or Firm*—Snell & Wilmer L.L.P.

(57) ABSTRACT

A pen and/or pencil having an opening positioned opposite its writing end for retaining or storing a cosmetic preparation which can be applied to a user. Caps may also be included to cover both the writing end and/or the opposite end containing the cosmetic preparation. The cap covering the cosmetic preparation may also include an applicator such as a wand having a flat, round, or brush shaped tip.

5 Claims, 7 Drawing Sheets

PEN/PENCIL APPARATUS HAVING COSMETIC APPLICATION

CROSS-REFERENCE TO RELATED APPLICATIONS

This patent application is a continuation of Ser. No. 10/308,824 filed Dec. 2, 2002, which claims the benefit of provisional application Ser. No. 60/334,143 filed Nov. 28, 2001.

FIELD OF INVENTION

The present invention generally relates to a pen and/or pencil apparatus having a cosmetic application and, more particularly, to a pen and/or pencil apparatus containing a cosmetic preparation and/or cosmetic applicator.

BACKGROUND OF THE INVENTION

Companies that produce cosmetic products are continually trying to make their products more marketable by making them smaller and more compact thereby allowing them to be conveniently carried in a user's purse or handbag, or even in a student's backpack. Such companies also know that aside from reducing the space required to carry such items, users of cosmetic products value products that are convenient to use yet capable of discreetly being carried.

Accordingly, in an effort to provide compact cosmetic products that can be easily accessed for use while being discreetly carried, the present invention uses small everyday functional items such as pens and pencils to dually function as carriers of cosmetic products.

SUMMARY OF THE INVENTION

The present invention is directed to a pen and/or pencil apparatus comprising a first end containing lead or ink for writing, and at least one second end containing a cosmetic preparation for application to a user. The cosmetic preparation may include one or more of a lipstick, a lipliner, a lip color, an eyeliner, an eyelid color, an eyebrow pencil, a cheek color, a mascara, and any other cosmetic preparation capable of being contained within a tubular shaped opening having a diameter approximately equal to the diameter of a functioning pen and/or pencil. The pencil may be either a regular lead based pencil or a mechanical pencil having a telescoping feature to expose additional lead. The pen may be any type of pen such as, for example, a roller ball, a felt tip, etc., and may also have a telescopic feature for presenting the pen during use and storing the pen when not in use.

In one aspect of the invention, the first and second ends of the pen and/or pencil may have caps to cover the ink, lead, or cosmetic preparation when not in use. In another aspect of the invention, a cap covering the end containing the cosmetic preparation may include an applicator attached thereto for applying the cosmetic preparation. In still another aspect of the invention, the applicator may include a wand and a tip that is flat, rounded or brush shaped for applying the cosmetic.

In yet another aspect of the invention, the end of the pen and/or pencil containing the cosmetic preparation may also include a telescopic feature for presenting non-used portions of the cosmetic preparation when visible portions of the preparation are used up.

The present invention is also directed to a method for making a pen and/or pencil apparatus having a cosmetic application which includes providing a tubular member having first and second ends, installing a writing element Such as a pen or pencil tip and ink(or lead in one end of the tubular member for writing, and installing a cosmetic preparation in the opposite end of the tubular member for application to a user.

BRIEF DESCRIPTION OF THE DRAWINGS

Additional aspects of the present invention will become more evident upon reviewing the non-limiting embodiments described in the specification and claims taken in conjunction with the accompanying figures, wherein like numerals designate like elements, and:

DETAILED DESCRIPTION

Preferred exemplary embodiments of the present invention will hereafter be described in conjunction with the description that follows. It will be understood that the detail provided herein is for illustration purposes only and that the subject invention is not so limited.

While specific embodiments of the pen/pencil apparatus having cosmetic application will be described in greater detail below, in general, the apparatus of the present invention includes a pen and/or pencil having a first end containing ink or lead for writing, and a second end containing a cosmetic preparation for application to a user.

Figure 1:
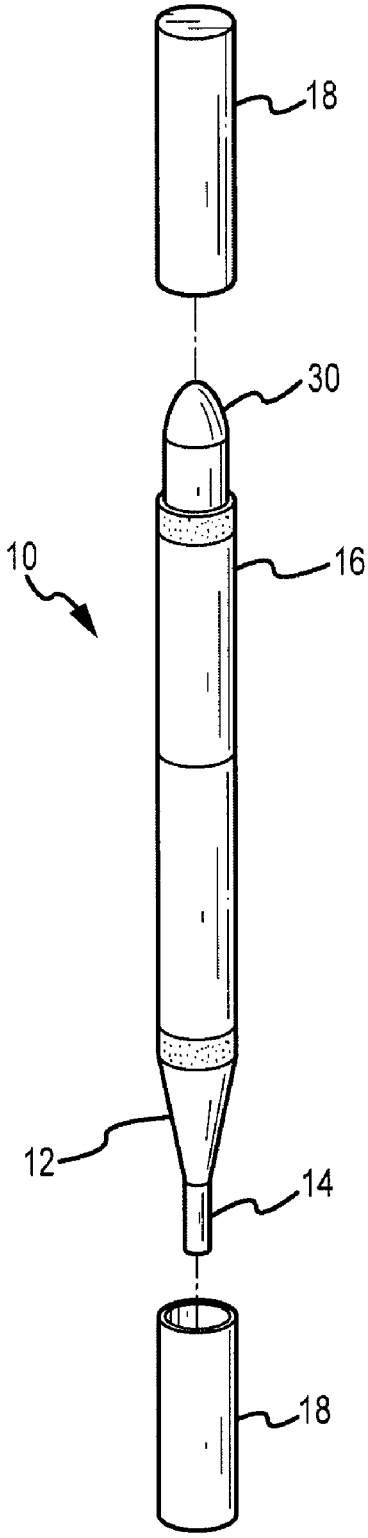
FIGS. 1 and 2 are perspective views of a mechanical pencil and roller ball pen, respectively, each having a rounded lip gloss applicator positioned on their opposite ends.
Figure 2:
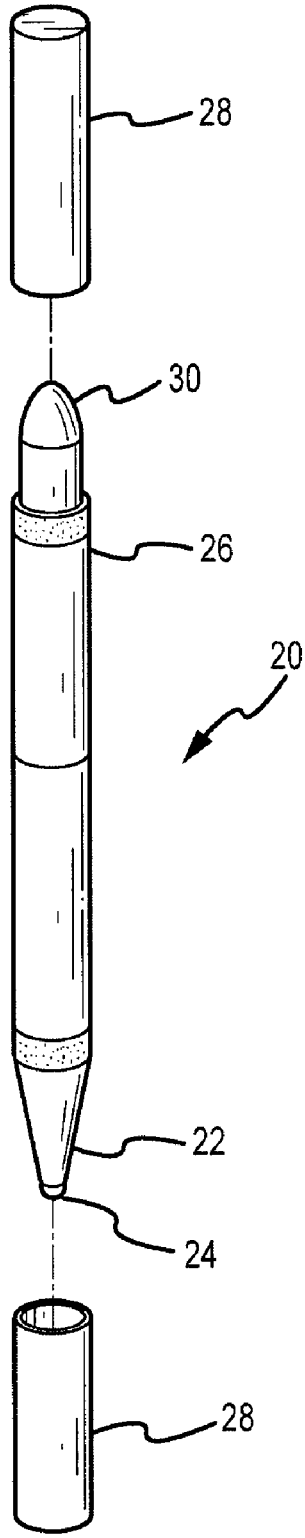

FIGS. 1 and 2 show perspective views of a mechanical pencil 10 and roller ball pen 20, respectively, each having a rounded lip gloss applicator 30 positioned on their opposite ends. Pencil 10 includes first end 12 having lead 14 for writing and second end 16 having applicator 30 for applying lipgloss and the like. Pencil 10 may also include one or more caps 18 for covering lead 14 and applicator 30 when not in use. It will also be understood by those skilled in the art that ends 12 and 16 of pencil 10 may include telescopic members which allow lead 14 and applicator 30 to be alternatively projected and retracted within ends 12 and 16, respectively.

Pen 20 shown in FIG. 2 includes first end 22 having roller ball tip 24 and second end 26 having applicator 30 for applying lipgloss and the like. Like pencil 10, pen 20 may also include one or more caps 28 to cover first and second ends 22 and 26. First and second ends 26 and 28 may also include telescopic members. Applicator 30 may also be replaced with a lipstick which can be projected and retracted within second ends 16 and 26 of pencil 10 and pen 20, respectively.

Figure 3:
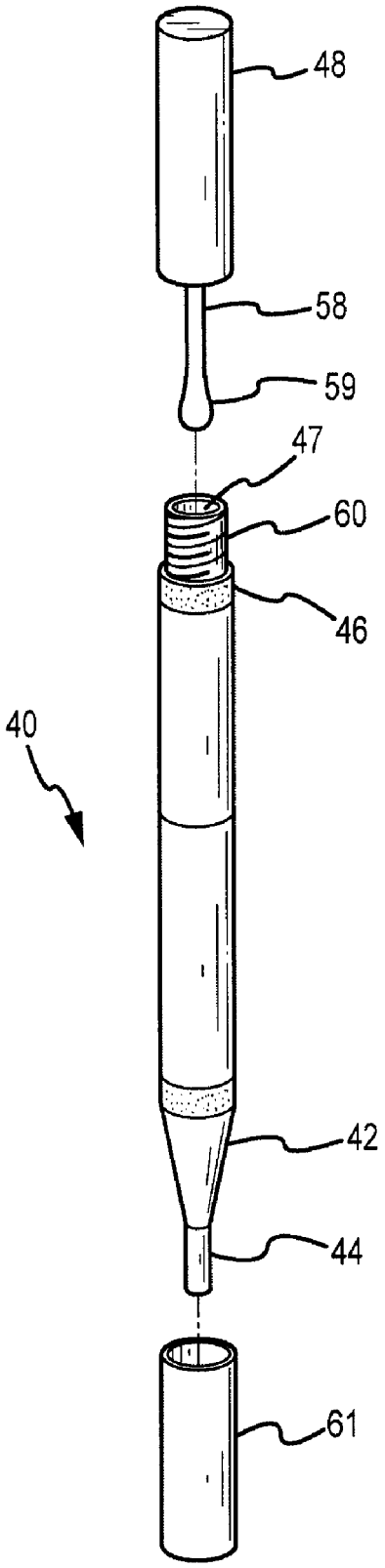
FIGS. 3 and 4 are perspective views of a mechanical pencil and roller ball pen, respectively, each having screw caps including wand applicators with rounded tips positioned at their opposite ends.
Figure 4:
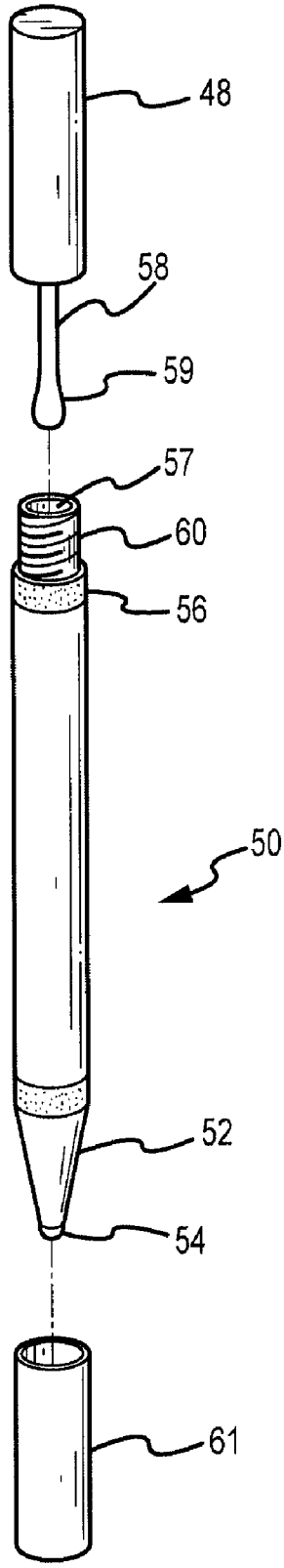

Turning now to FIGS. 3 and 4, perspective views of a mechanical pencil 40 and roller ball pen 50, respectively, are shown each having screw caps 48 including wand applicators 58 with rounded tips 59 positioned at their opposite ends. Pencil 40 includes first end 42 having lead 44 for writing and second end 46 having threads 60 which mate with screw cap 48 to secure screw cap 48 to second end 46 of pencil 40. Second end 46 has an opening 47 that is contiguous with a reservoir (see, for example, reference number 85 in FIG. 13) which functions to retain a cosmetic preparation. Pen 50 includes first end 52 having roller ball tip 54 and second end 56 having threads 60 which mate with screw cap 48 to secure crew cap 48 to second end 56 of pen 50. Second end 56 has an opening 57 that is contiguous with a reservoir (see, for example, reference number 85 in FIG. 13) which functions to retain a cosmetic preparation. Pencil 40 and pen 50 may also include a cap 61 for covering the first ends 42 and 52 of the pencil 40 and pen 50, respectively, when not in use.

Any number of cosmetic preparations may be contained within the reservoirs contiguous with openings 47 and 57 of ends 46 and 56 of pencil 40 and pen 50, respectively, thereby enabling tip 59 of applicator wand 58 to absorb and retain the cosmetic prior to its application to a user. Examples of suitable cosmetic preparations include, but are not limited to, powders, creams and lotions for eyes, cheeks and lips.

Figure 5:
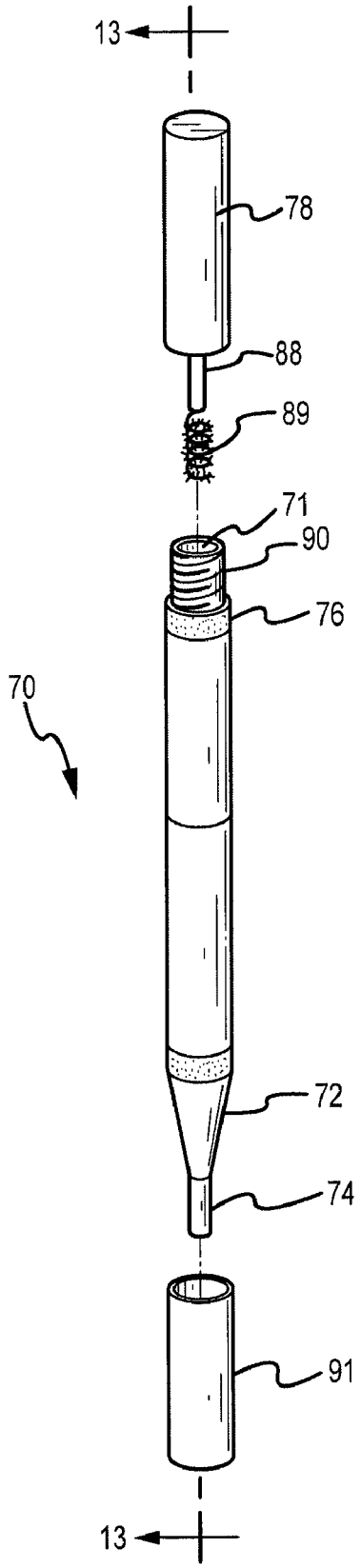
FIGS. 5 and 6 are perspective views of a mechanical pencil and roller ball pen, respectively, each having screw caps including wand applicators with brushes positioned at their opposite ends.
Figure 6:
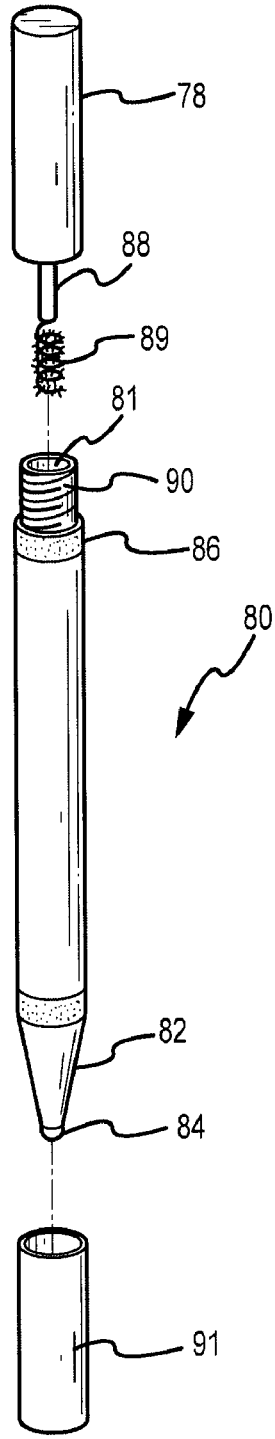

FIGS. 5 and 6 show perspective views of a mechanical pencil 70 and roller ball pen 80, respectively, each having screw caps 78 including wand applicators 88 with spiral brushes 89 positioned at their opposite ends. Pencil 70 includes first end 72 having lead 74 for writing and second end 76 having threads 90 which mate with screw cap 78 to secure crew cap 78 to second end 76 of pencil 70. Second end 70 has an opening 71 that is contiguous with a reservoir (see, for example, reference number 85 in FIG. 13) which functions to retain a cosmetic preparation. Pen 80 includes first end 82 having roller ball tip 84 and second end 86 having threads 90 which mate with screw cap 78 to secure screw cap 78 to second end 86 of pen 80. Second end 86 has an opening 81 that is contiguous with a reservoir (see, for example, reference number 85 in FIG. 13) which functions to retain a cosmetic preparation. Pencil 70 and pen 80 may also include a cap 91 for covering the first ends 72 and 82 of pencil 70 and pen 80, respectively, when not in use. Mascara is just one example of a suitable cosmetic preparation that might be used with spiral brush 89 of applicator wand 88.

Figure 13:
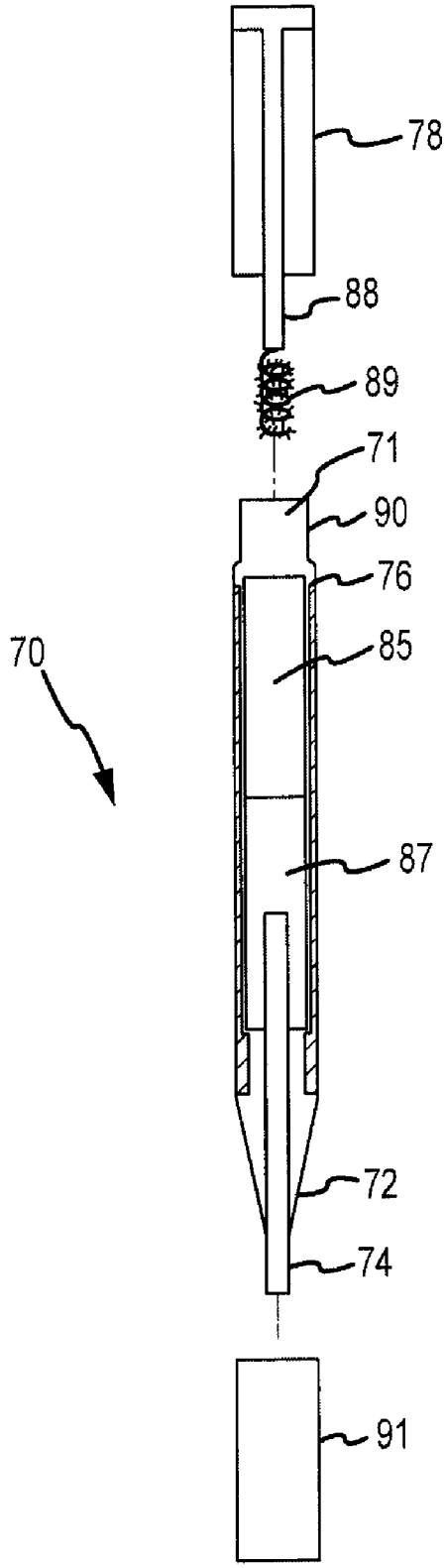
FIG. 13 is a cross-sectional view of FIG. 5 taken along line 13-13 of FIG. 5 to show the telescopic elements for presenting lead or ink at one end of the pen and/or pencil.

FIG. 13 shows a cross-sectional view taken along line 13-13 of FIG. 5.

FIG. 13 shows a telescopic element 87 contained within the pen and/or pencil apparatus which enables unused portions of a lead or ink based substrate to be extended from the first end 72 of the apparatus. FIG. 13 also shows a reservoir 85 contiguous with an opening 71 at the second end 76 of pencil 70.

Figure 7:
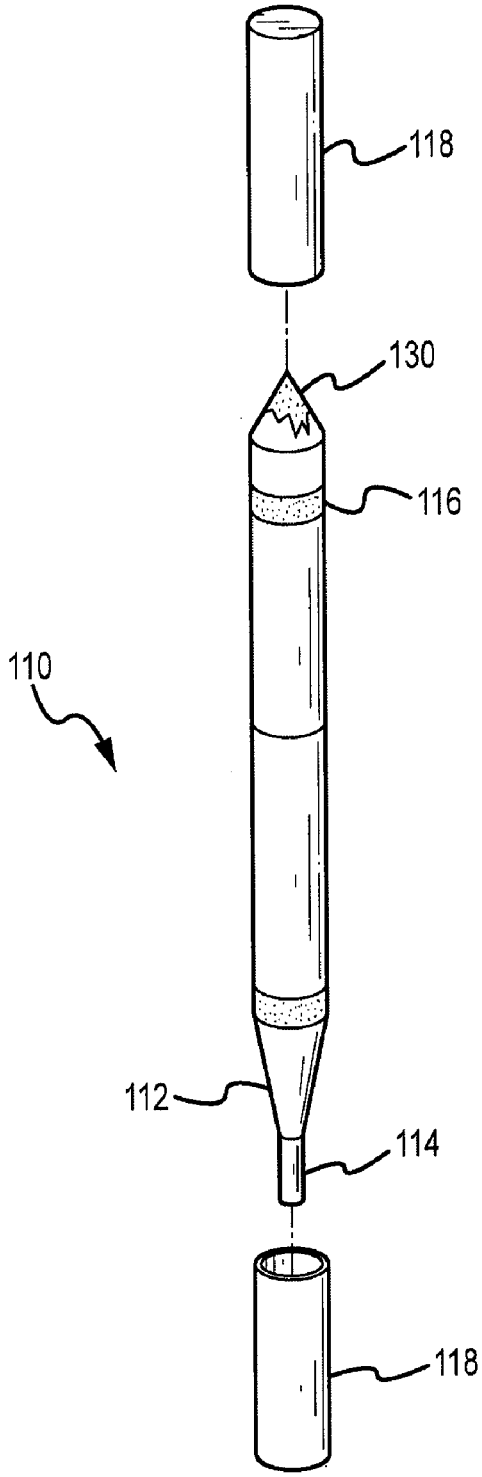
FIGS. 7 and 8 are perspective views of a mechanical pencil and roller ball pen, respectively, each having a lip or eye color pencils positioned at their opposite ends.
Figure 8:
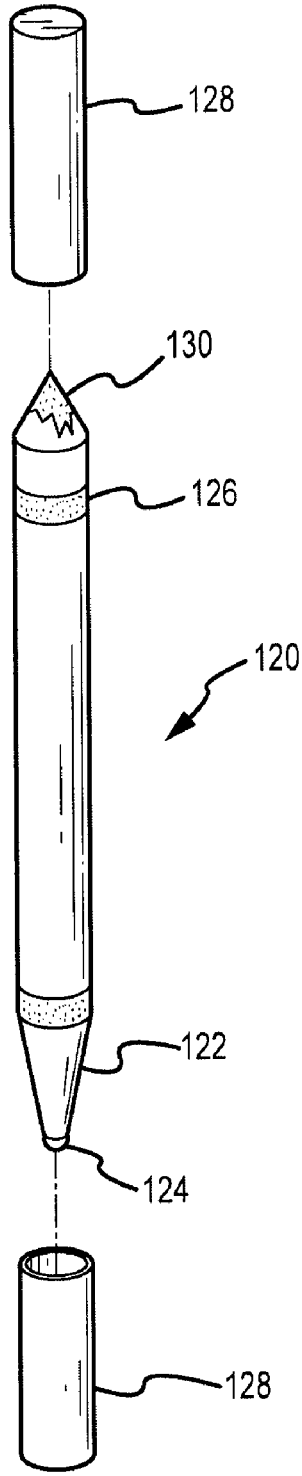

FIGS. 7 and 8 are perspective views of a mechanical pencil 110 and roller ball pen 120, respectively, each having a lip or eye color pencils positioned at their opposite ends. Pencil 110 includes first end 112 having lead 114 for writing and second end 116 having cosmetic pencil 130 for applying lip color, eye color, and the like. Pencil 110 may also include one or more caps 118 for covering lead 114 and cosmetic pencil 130 when not in use. It will also be understood by those skilled in the art that ends 112 and 116 of pencil 110 may include telescopic members which allow lead 114 and cosmetic pencil 130 to be alternatively projected and retracted within ends 112 and 116, respectively.

Pen 120 shown in FIG. 8 includes first end 122 having roller ball tip 124 and second end 126 having cosmetic pencil 130 for applying lip color, cheek color, eye color, and the like. Like pencil 110, pen 120 may also include one or more caps 128 to cover first and second ends 122 and 126. First and second ends 122 and 126 may also include telescopic members. Cosmetic pencil 130 may also be replaced with a lipstick which can be projected and retracted within second ends 116 and 126 of pencil 110 and pen 120, respectively.

Figure 9:
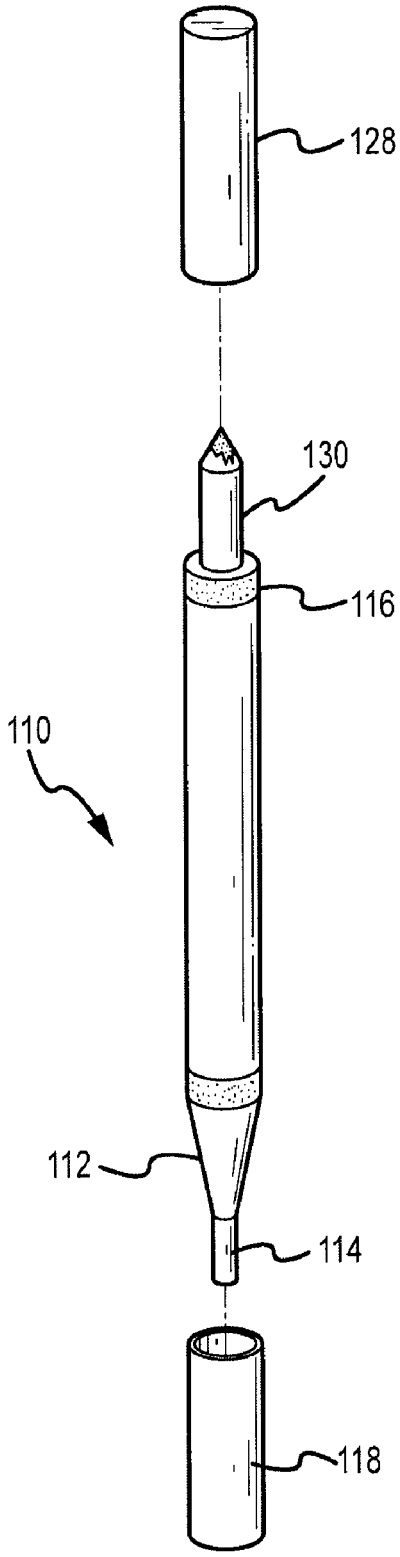
FIGS. 9 and 10 are perspective views of a mechanical pencil and roller ball pen, respectively, each having a lipliner or eyeliner pencil positioned at their opposite ends.
Figure 10:
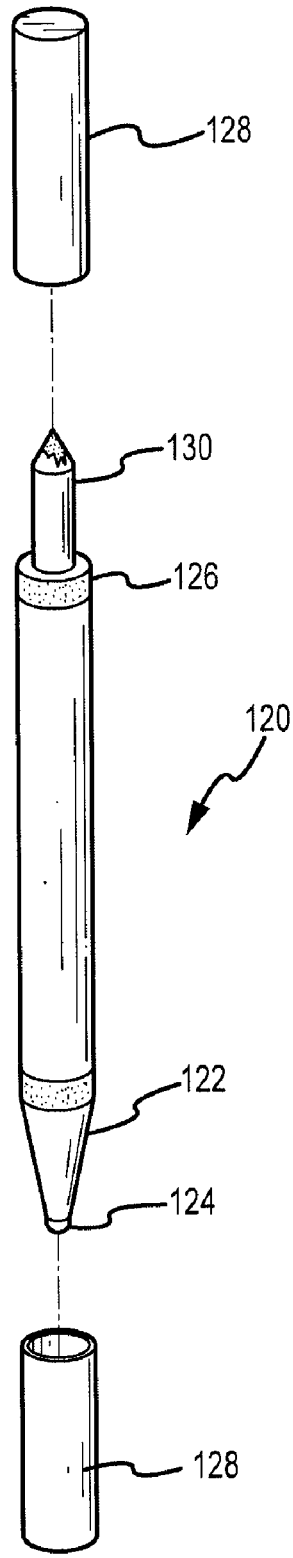

FIGS. 9 and 10 are similar to FIGS. 7 and 8, previously described, with the exception that cosmetic pencil 130 shown in FIGS. 9 and 10 is smaller for cosmetic preparations such as eyeliners, lipliners, and the like.

Figure 11:
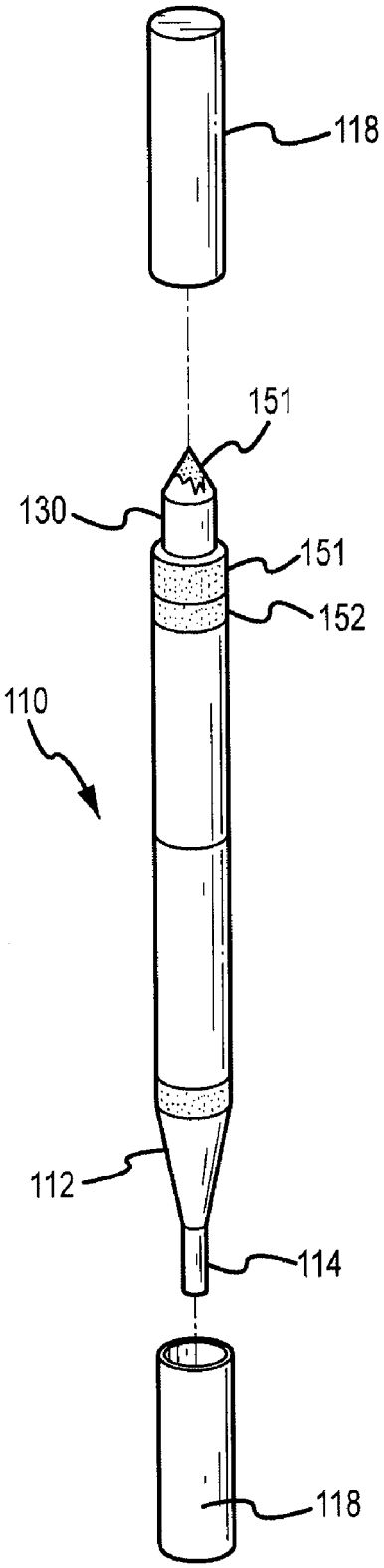
FIGS. 11 and 12 are perspective views of a mechanical pencil and roller ball pen, respectively, each having more than one lip or eye color pencil positioned at their opposite ends.
Figure 12:
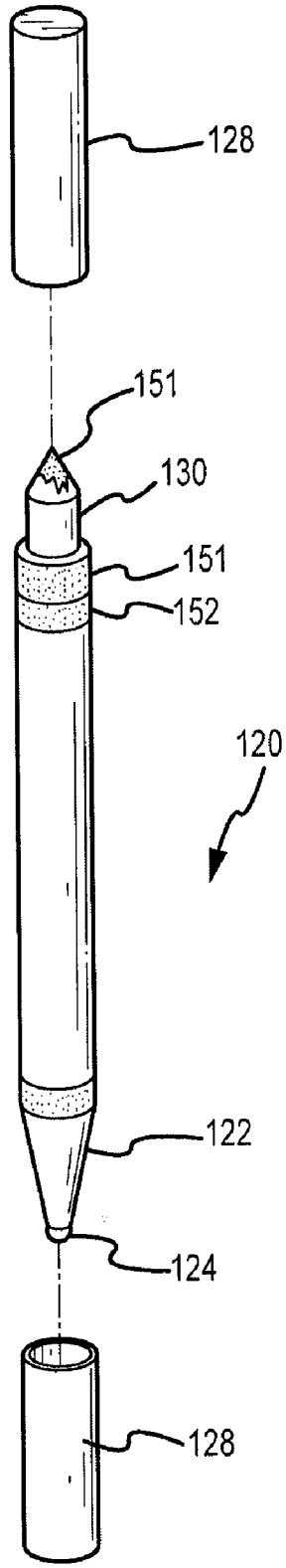

Finally, FIGS. 11 and 12 show perspective views of a mechanical pencil and roller ball pen, respectively, each having more than one lip or eye color pencil positioned at their opposite ends. For example, cosmetic pencils 130 having different colors 151 and 152 may be stacked on top of one another so that a user may have access to a variety of colors for cosmetic application.

While various principles of the invention have been described in illustrative embodiments, many combinations and modifications of the above described structures, arrangements, proportions, elements, materials and components used in the practice of the invention in addition to those not specifically described may be varied and particularly adapted for specific environments and operating requirements, without departing from the principles of the present invention.

The invention claimed is:

1. A pen and/or pencil comprising a first end having at least one of a lead or an ink for writing by a user and a second end having a plurality of cosmetic pencils for application to a user for the purpose of beautifying a user stacked in relation to one another wherein the plurality of cosmetic pencils each comprise a different color.

2. The pen and/or pencil of claim 1 wherein the cosmetic pencils comprise a lip liner for application to a user's lips.

3. The pen and/or pencil of claim 1 wherein the cosmetic pencils comprise lipsticks for application to a user's lips.

4. The pen and/or pencil of claim 1 wherein the cosmetic pencils comprise eyeliner for application to a user's eyes.

5. The pen and/or pencil of claim 1 wherein the cosmetic pencils comprise brow liner for application to a user's eyebrows.

* * * * *